United States Patent [19]

Takagi

[11] 4,265,405

[45] May 5, 1981

[54] SPRINKLER NOZZLE

[76] Inventor: Tosio Takagi, 316-2, Wakazonominami-machi, Kokuraminami-ku, Kitakyushu-shi, Fukuoka-ken, Japan

[21] Appl. No.: 81,081

[22] Filed: Oct. 1, 1979

[30] Foreign Application Priority Data

Oct. 9, 1978 [JP] Japan ..... 53-138791[U]
Mar. 2, 1979 [JP] Japan ..... 54-24644

[51] Int. Cl.[3] ..... B05B 1/16; B05B 1/32

[52] U.S. Cl. ..... 239/440; 239/444; 239/457; 239/539

[58] Field of Search ..... 239/390, 391, 436–441, 239/443, 444–449, 451, 456, 457, 458, 460, 537, 538, 539, 541, 551, 562, 563, 574, 579, 581

[56] References Cited

U.S. PATENT DOCUMENTS

| | | | |
|---|---|---|---|
| 2,192,639 | 3/1940 | Eckard | 239/449 |
| 3,058,670 | 10/1962 | Marotto et al. | 239/390 X |
| 3,111,273 | 11/1963 | Mei | 239/441 X |

*Primary Examiner*—Andres Kashnikow
*Attorney, Agent, or Firm*—Wenderoth, Lind & Ponack

[57] ABSTRACT

An improved sprinkler nozzle is provided which comprises a base tube, a nozzle body, an inner tube and an outer tube screwed one upon another. Water can not only be sprinkled but also be discharged in a desired type of flow by adjusting three valves formed between the above-mentioned four tubular elements.

2 Claims, 3 Drawing Figures

SPRINKLER NOZZLE

The present invention relates to a sprinkler nozzle to be attached to the end of a hose connected to a water tap.

The conventional sprinkler nozzle of this type permits selection from three modes of operation: sprinkling, straight flow and stop. With such a conventional nozzle, however, there was a problem that a slow flow and a dripping flow were unobtainable. Decreasing the volume of water by adjusting the nozzle merely increased the sprinkling pressure. Another problem was that with the nozzle attached to a hose, it was impossible to fill a large container with water quickly because a large flow rate was unobtainable.

An object of the present invention is to provide an improved sprinkler nozzle which obviates the aforementioned shortcomings.

Other features and advantages of this invention will become apparent from the following description taken with reference to the accompanying drawings, in which.

Figure 1:
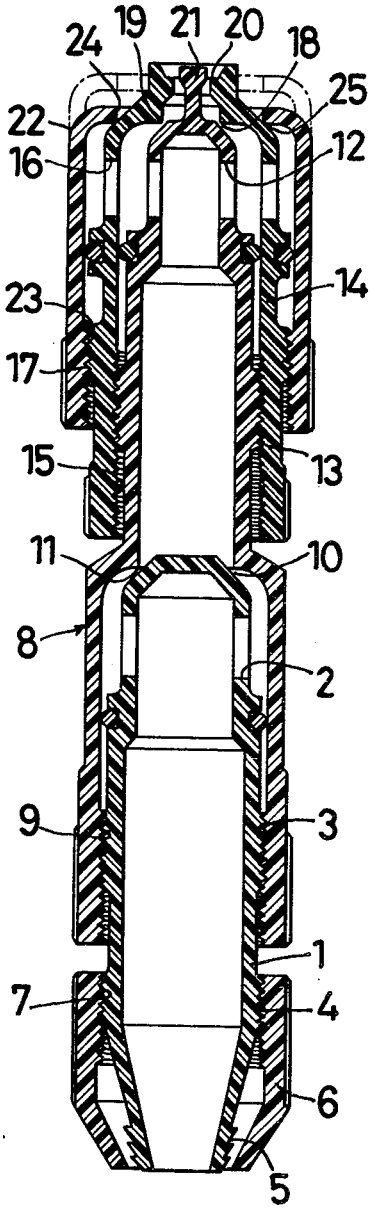
FIG. 1 is a vertical sectional view of the first embodiment of this invention.

Referring to FIG. 1, a base tube 1 is provided with holes 2 near its closed tip. The tube 1 has two male threads 3 and 4 at its middle portion and terminates with a tapered and jagged end 5. A hose clamping tube 6 with a female thread 7 is screwed on the lower end of the base tube 1 with the lower male thread 4 engaging the female thread 7. A hose is put on the jagged end 5 and clamped by screwing the hose clamping tube 6 on the base tube 1.

A nozzle body 8 has a female thread 9 formed on its large-diameter lower end so as to engage the upper male thread 3 on the base tube 1. A valve 10 is formed between the closed tip of the base tube 1 and a shoulder 11 formed on the inside of the nozzle body 8. The opening of the valve 10 is adjusted by turning the nozzle body 8 with respect to the base tube 1.

The nozzle body 8 has holes 12 near its upper end and has a male thread 13 between the holes 12 and the shoulder 11. An inner tube 14 has a female thread 15 so as to engage the male thread 13 on the nozzle body 8. The inner tube 14 has holes 16 near at its tip and has a male thread 17 formed on its middle portion.

A valve 18 for controlling the volume of water is formed between the closed top of the nozzle body 8 and a shoulder 19 formed inside of the inner tube 14 near its top. The opening of the valve 18 can be adjusted by turning the inner tube 14 with respect to the nozzle body 8. A nozzle opening 20 is formed between an open upper end of the inner tube and a projection 21 extending from the closed top of the nozzle body 8 so that water is sprayed from the nozzle opening 20.

An outer tube 22 has a female thread 23 so as to engage the male thread 17 on the inner tube 14 and has at its top an opening 24 through which the open top of the inner tube 14 projects. A valve 25 is formed where the top edge of the outer tube 22 engages a shoulder formed on the inner tube 14. The opening of the valve 25 is controlled by turning the outer tube 22 with respect to the inner tube 14.

Figure 2:
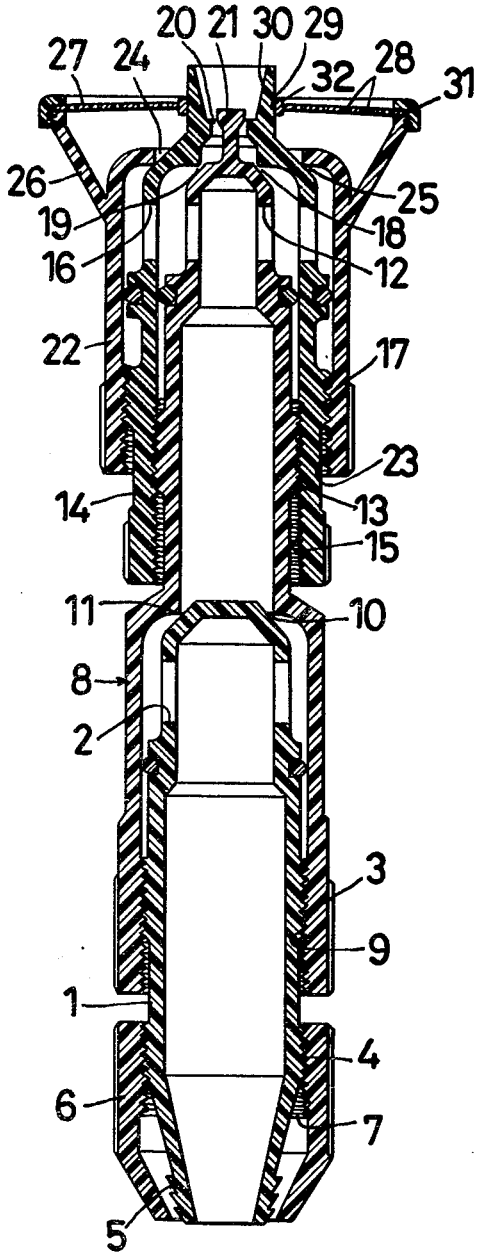
FIG. 2 is a similar view of the second embodiment.

Referring to FIG. 2 showing the second embodiment in which the same reference numerals are used to designate the same or corresponding parts, a skirt 26 is formed near the upper end of the outer tube 22. An open top of the skirt is adapted to be closed by a perforated plate 27 formed with a plurality of perforations 28. The plate 27 has in its center a round hole 29 large just enough to receive an open end 30 of the inner tube 14. The plate 27 is clamped by a cap nut 31 to the skirt 26. A rubber ring 32 is put around the open end 30 of the inner tube to assure water tightness. This plate is removable, of course, when unnecessary.

In use of the sprinkler nozzle according to the present invention, one end of a hose is mounted on its jagged end 5 and clamped by the clamping tube 6 and its other end is connected to a water tap.

For ordinary sprinkling, the valves 10 and 18 are opened with the valve 25 fully closed. A desired amount of water can be sprinkled from the nozzle opening 24 with a suitable pressure by adjusting the openings of the valves 10 and 18.

When the valve 25 is opened by turning the outer tube 22, water flows out of the opening 24 so that water from the nozzle opening 20 will not be sprinkled but be discharged in an ordinary flow because of a drop in water pressure. Any large flow rate can be obtained by increasing the openings of the valves 10 and 25.

To obtain a slow flow or a dripping flow, the flow through the valve 10 is throttled and the valve 25 is adjusted to have a larger opening than the valve 10.

Figure 3:
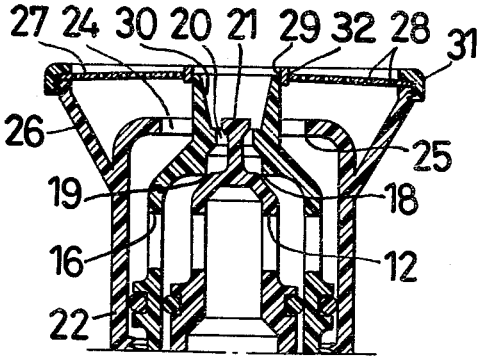
FIG. 3 is a view of a portion of the second embodiment showing the use as a shower nozzle.

With the second embodiment, when the perforated plate 27 is mounted on the skirt 26 and the valves 10 and 25 are opened with the valve 18 closed as shown in FIG. 3, water will be showered through the perforations in the plate 27. If the valve 25 is closed, water is sprinkled through the nozzle opening 20.

It will be understood from the foregoing that the sprinkler nozzle according to this invention permits sprinkling as well as discharge in an ordinary flow, a slow flow, a dripping flow and a rapid and great flow by adjusting the valve formed between the base tube and the nozzle body, the valve between the nozzle body and the inner tube, and the valve between the inner tube and the outer tube.

It will be understood that many changes or modifications can be made within the scope and spirit of the present invention.

What I claim:

1. A sprinkler nozzle comprising:

a base tube having a closed tip and a lower end adapted to receive a hose, a tubular nozzle body having a closed tip and screwed on said base tube and communicating with said base tube, said nozzle body being formed with an inside shoulder which engages the closed tip of said base tube to serve as a first valve, an inner tube screwed on said nozzle body and communicating with said nozzle body, said inner tube being formed with an inside shoulder which engages said nozzle body to serve as a second valve, said inner tube having an open end which cooperates with a projection extending from the top of said nozzle body to serve as a nozzle opening, and an outer tube screwed on said inner tube and communicating with said inner tube, said outer tube having an open top edge which engages said inner tube to serve as a third valve.

2. The sprinkler nozzle as claimed in claim 1 wherein said outer tube has a skirt adapted to receive a perforated plate through which water is showered when said first and third valves are opened with the second valve closed.

* * * * *